US006599118B2

(12) United States Patent
Pisupati

(10) Patent No.: US 6,599,118 B2
(45) Date of Patent: Jul. 29, 2003

(54) METHOD AND SYSTEM FOR REDUCING NITROGEN OXIDES AND CARBON LOSS FROM CARBONACEOUS FUEL COMBUSTION FLUE EMISSIONS

(75) Inventor: Sarma V. Pisupati, Lemont, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 10/085,545

(22) Filed: Feb. 28, 2002

(65) Prior Publication Data

US 2002/0119407 A1 Aug. 29, 2002

Related U.S. Application Data

(60) Provisional application No. 60/272,092, filed on Feb. 28, 2001.

(51) Int. Cl.[7] ..... F23M 3/00
(52) U.S. Cl. ..... 431/10; 431/9; 431/115
(58) Field of Search ..... 60/39.02; 110/346; 201/21; 202/99; 208/409; 431/10, 9, 5, 231, 235, 115

(56) References Cited

U.S. PATENT DOCUMENTS

| | | | | | |
|---|---|---|---|---|---|
| 4,078,973 | A | * | 3/1978 | Choi et al. | 201/21 |
| 4,088,541 | A | * | 5/1978 | Choi et al. | 202/99 |
| 4,172,431 | A | | 10/1979 | Tatem et al. | 122/5 |
| 4,249,470 | A | | 2/1981 | Vatsky | 110/232 |
| 4,469,032 | A | | 9/1984 | Yan | 110/342 |
| 4,667,467 | A | * | 5/1987 | Archer et al. | 60/39.02 |
| 4,774,895 | A | | 10/1988 | Christmann | 110/234 |
| 4,880,528 | A | * | 11/1989 | Westhoff et al. | 208/409 |
| 5,045,180 | A | | 9/1991 | Comolli | 208/413 |
| 5,178,101 | A | | 1/1993 | Bell | 122/4 |
| 5,291,841 | A | | 3/1994 | Dykema | 110/347 |
| 5,388,534 | A | | 2/1995 | Doron et al. | 110/233 |
| 5,501,160 | A | | 3/1996 | Goldman et al. | 110/229 |
| 5,505,144 | A | | 4/1996 | Doron et al. | 110/233 |
| 5,669,317 | A | | 9/1997 | May et al. | 110/229 |
| 5,857,421 | A | * | 1/1999 | Doron et al. | 110/346 |
| 5,967,061 | A | | 10/1999 | Ashworth et al. | 110/203 |
| 6,398,825 | B1 | | 6/2002 | Siniakevith et al. | 48/197 |

* cited by examiner

*Primary Examiner*—Henry Bennett
*Assistant Examiner*—Sabrina Dagostino
(74) *Attorney, Agent, or Firm*—Ohlandt, Greeley, Ruggiero & Perle, L.L.P.

(57) ABSTRACT

There is provided methods and systems for the reduction of nitrogen oxides and carbon loss from carbonaceous fuel combustion flue emissions. The preferred carbonaceous fuel is coal. The invention provides methods and systems comprising the use of coal as a reburn fuel for coal combustion systems. The invention comprises low temperature pyrolysis producing gaseous hydrocarbons for the reduction of nitrogen oxides and treatment of char with resulting reduction of carbon loss.

30 Claims, 2 Drawing Sheets

METHOD AND SYSTEM FOR REDUCING NITROGEN OXIDES AND CARBON LOSS FROM CARBONACEOUS FUEL COMBUSTION FLUE EMISSIONS

This application claims priority from U.S. Provisional Patent Application Serial No. 60/272,092, filed on Feb. 28, 2001.

FIELD OF THE INVENTION

The present invention relates to the combustion of carbonaceous fuels. More particularly, the present invention related to the reduction of oxides of nitrogen and carbon loss from the flue emissions produced from the combustion of carbonaceous fuels. Still more particularly, methods and systems involving both the reduction of nitrogen oxides and carbon loss from the flue emission produced from the combustion of carbonaceous fuels, particularly coal, are provided.

DESCRIPTION OF THE PRIOR ART

By way of background, the combustion of carbonaceous fuels such as coal generates by-products, including various oxides of carbon, carbon dioxide, carbon monoxide, water vapor, sulfur dioxides, and nitrogen oxides. These primary gases, along with unused oxygen and nitrogen from the air used for combustion, constitute the flue gas. Sulfur dioxide and oxides of nitrogen are significant pollutants released into the atmosphere from the combustion of carbonaceous fuels. These two gases are primarily responsible for acid rain and result in environmental damage. Both sulfur dioxide and nitrogen oxides are subject to governmental regulation, including requirements under the Clean Air Act Amendments of 1990. In addition, oxides of nitrogen not only cause acid rain, but also produce ground level ozone by reacting with volatile organic compounds emitted primarily from internal combustion engines involved with transportation. The ozone produced from nitrogen oxides migrates widely and causes problems in regions removed from the site of production. In view of the public concern over ozone damage, various regulations for reducing the emissions of nitrogen oxides have been enacted and new regulations are becoming more stringent.

Various methods are currently used to reduce nitrogen oxides. Present methods to control the emission of nitrogen oxides include burner air staging, furnace air and flue staging (reburning), flue gas recirculation, selective catalytic reduction, and selective non-catalytic reduction. The main principle of the air staging technique is to reduce the level of available oxygen in zones or regions where oxygen is a critical requirement for the formation of nitrogen oxides. The amount of fuel burnt or combusted at the peak temperature is also reduced. Fuel staging, or reburning, is another method of reducing nitrogen oxides by a part of the fuel above the main combustion zone. The hydrocarbon radicals that are released from this fuel reduce nitrogen oxides from the primary combustion zone. However, it should be noted that the main limitation for this method is that the fuel has to be very reactive because of the short residence time that is available for complete combustion after the reburn fuel is introduced. Therefore, natural gas is primarily used as a reburn fuel, although other fuels such as oil, coal, biomass-based products have been used. Selective catalytic reduction uses chemicals such as $NH_3$ to reduce nitrogen oxides over catalysts that are expensive. Ammonia is a hazardous chemical to handle. Another problem in the industry, high un-burnt carbon, is most often encountered with low nitrogen oxide burners. With low nitrogen oxide burners, as the oxygen concentration is reduced in the near burner zone, the combustion process is delayed leading to high un-burnt carbon. This is usually indicated by and called LOI (Loss on Ignition).

With current reburning or fuel staging methodology, a part of the fuel is admitted downstream of the main combustion zone. This method requires that the fuel be very reactive and with less nitrogen since the time available for complete combustion is short. The problem with using coal as a reburn fuel is that the volatiles produced from combustion can be used to reduce nitrogen oxides, but the char increases the unburnt carbon loss. Accordingly, coal is not a preferred choice.

U.S. Pat. No. 5,967,061 is directed to a method and system for reducing nitrogen oxide and sulfur oxide emissions from carbonaceous flue gases. U.S. Pat. No. 5,045,180 is directed to a process for catalytic multi-stage hydrogenation of coal. U.S. Pat. No. 5,178,101 is directed to a method for reducing oxides of nitrogen generated in a coal-fired fluidized bed boiler. U.S. Pat. No. 5,291,841 is directed to a process for combustion of coal to maximize combustion efficiency while minimizing emissions of sulfur and nitrogen oxides.

In light of current technology, there still remains a long-felt need for methods and systems that reduce nitrogen oxides and carbon loss from carbonaceous fuel combustion flue emissions, especially when coal is the fuel. Methods and systems that are easily implemented with existing carbonaceous fuel combustion systems are particularly desirable.

Accordingly, it is an object of the present invention to provide a method for the reduction of nitrogen oxides from carbonaceous fuel combustion flue emissions.

It is another object of the present invention to provide a method for the reduction of carbon loss from carbonaceous fuel combustion flue emissions.

Yet another object of the present invention is to provide a system for reducing oxides of nitrogen and carbon loss from carbonaceous fuel combustion flue emissions.

Still another object of the present invention is to provide a method and system for the reduction of nitrogen oxides and carbon loss from coal combustion flue emissions.

These and other objects and advantages of the present invention and equivalents thereof, are achieved by the methods and systems of the present invention described herein and manifest in the appended claims.

SUMMARY OF THE INVENTION

In accordance with the objects outlined above and other objects, the present invention provides methods and systems for reducing nitrogen oxides and carbon loss from carbonaceous fuel combustion flue emissions. The method of the invention comprises heating a first portion of carbonaceous fuel to a first temperature in a first chamber (external to the main burner system or within the main burner system) sufficient to thermally decompose the carbonaceous fuel to produce a first gaseous stream and a char fraction; adding the char fraction directly to the main burner, or to a second portion of the carbonaceous fuel, and combusting at a second temperature in a second furnace chamber (main burner) to produce a second gaseous stream (combustion products); and adding the first gaseous stream downstream to the second gaseous stream. The thermal decomposition, or low temperature pyrolysis, is at a temperature from about 600° C. to about 850° C., preferably about 600° C. to about 700° C. The combustion of the second portion of the carbonaceous fuel is preferably at a temperature from about 1300° C. to about 1700° C. The preferred carbonaceous fuel is coal. The first portion of the carbonaceous fuel, preferably coal, is in an amount from about 15 wt % to about 50 wt % and the second portion of the carbonaceous fuel is preferably in an amount from about 50 wt % to about 85 wt % of the total weight of the fuel. Preferably, the char fraction from the first chamber and the second portion of the coal is pulverized prior to combusting at the second temperature. In one embodiment, the combined first gaseous stream from thermal decomposition or low temperature pyrolysis (pyrolysis products) are combined with the second gaseous stream (main combustion products) in the first furnace chamber. Carbonaceous fuel is selected form the group of coal, biomass, petroleum coke, bitumen, fuel oil, non-aqueous mixtures thereof, and aqueous mixtures thereof.

The present invention also provides a system for reduction of nitrogen oxides and carbon loss from carbonaceous fuel combustion flue emissions. The system comprises a means for thermally decomposing a first portion of the carbonaceous fuel at a first temperature; a means for combusting a second portion of the carbonaceous fuel at a second temperature (in the main burner); a means for adding the first gaseous stream to the second gaseous stream downstream from the second gaseous stream; and a means for adding the char fraction to the second portion of the carbonaceous fuel prior to combusting the second portion of the carbonaceous fuel. The preferred carbonaceous fuel of the system is coal. The system further comprises a means for recycling combustion flue emissions located downstream from the means for adding the first gaseous stream to the second gaseous stream to the means for thermally decomposing the first portion of the carbonaceous fuel. Also, the system further preferably comprises a means for pulverizing the char fraction and the second portion of the carbonaceous fuel prior to combusting the char fraction and the second carbonaceous fuel portion. The thermal decomposition means, or low temperature pyrolysis means, is preferably at a temperature from about 600° C. to about 850° C., preferably about 600° C. to about 700° C. The means for combusting the second portion of the carbonaceous fuel is preferably at a temperature from about 1300° C. to about 1700° C. The first portion of the carbonaceous fuel of the system is preferably in an amount from about 15 wt % to about 50 wt %, and the second portion of the carbonaceous fuel of the system is preferably in an amount from about 50 wt % to about 85 wt % of the total weight of the fuel.

DETAILED DESCRIPTION OF THE INVENTION

Figure 1:
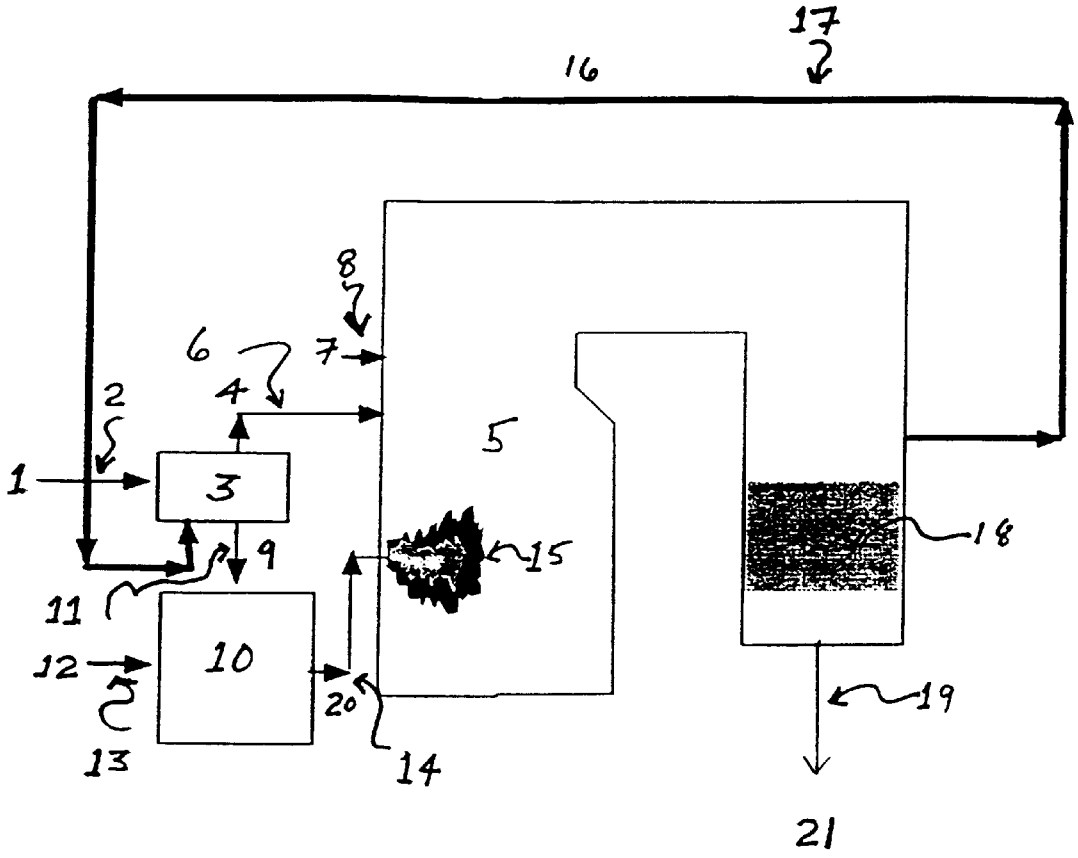
FIG. 1 illustrates a coal reburning system for reducing oxides of nitrogen and carbon loss.

In order to promote an understanding of the principles of the invention, reference will be made to the embodiment illustrated in the drawing along with specific description of the same. Nevertheless, it will be understood that no limitation of the scope of the invention is thereby intended, and alterations and further modifications of the illustrated system, as well as further applications of the principles of the invention as illustrated and described herein, are contemplated as would normally occur to one skilled in the art to which the invention relates.

As shown in FIG. 1, the system and associated methodology, involves coal reburning. While coal is a preferred embodiment of the invention, any convenient carbonaceous fuel may be adapted and employed, including but not limited to coal, biomass, petroleum coke, bitumen, fuel oil, non aqueous mixtures thereof, and aqueous mixtures thereof.

Referring to FIG. 1, a first portion of coal 1 is introduced by conveyance means 2 into the low temperature pyrolyzer or thermal decomposition furnace unit 3. Pyrolysis gases 4 from the thermal decomposition furnace unit 3 enters into the primary combustion furnace 5 by pathway means 6. Burnout air 7 enters furnace 5 by conveyance means 8. Char 9 produced from thermal decomposition unit 3 enters pulverizer unit 10 by conveyance means 11. A second portion of coal 12 enters pulverizer unit 10 by conveyance means 13. Pulverized coal and char material 20 enters into combustion furnace 5 by conveyance means 14. Combustion gases 15 are produced from the burning of pulverized char and coal material 20 in furnace 5. Flue gas 16 is cycled by recirculation means 17 into low temperature pyrolysis or thermal decomposition furnace unit 3. Flue gas 18 passes to the atmosphere 21 by venting means 19.

Figure 2:
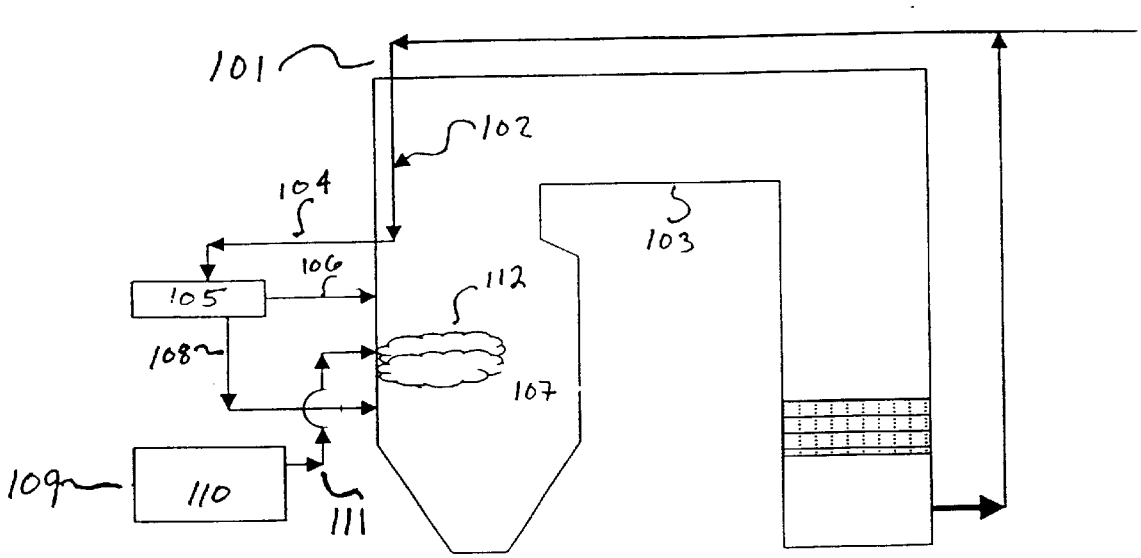
FIG. 2 is another embodiment of a coal reburning system for reducing oxides of nitrogen and carbon loss.

An alternative embodiment of a coal reburning system is shown in FIG. 2. Referring to FIG. 2, a first portion of coal 101 is introduced by conveyance means to a low temperature pyrolysis means 102 within the coal furnace 103. Pyrolysis products 104 enter separation means 105. Pyrolysis gases 106 enter main burner 107. A second portion of coal 109 enters pulverizer 110 and pulverized coal 111 enters main burner 107. Preferably, char 108 enters pulverizer 110 and enters main burner 107 with pulverized coal 111. Combustion gases 112 are produced from the burning of char 108 and coal 109 in main burner 107.

The present invention provides a new method for the reduction of nitrogen oxides as well as the reduction of carbon loss from carbonaceous fuel, preferably coal, combustion systems. The method involves heating carbonaceous fuel, preferably coal in what is called low temperature pyrolysis or thermal decomposition of coal. However, in addition to coal other carbonaceaous fuels such as biomass, petroleum coke, bitumen, fuel oil, non-aqueous mixtures thereof, and aqueous mixtures thereof, may be used. A preferred biomass is sawdust. A fraction of the total fuel supply (i.e., from about 15 wt % to about 50 wt % of the total weight of the coal) is heated to a temperature from about 600° C. to about 850° C., preferably about 600° C. to about 700° C. The amount of the coal depends on the volatile matter of the coal used. For example, carbonaceous fuels with about 4% volatile matter may require only about 20% of the fuel to be pyrolyzed. On the other hand, fuels with 25% volatile matter may require about 50% of the fuel to be pyrolyzed to supply enough pyrolysis products to reduce enough nitrogen oxides. The low temperature pyrolysis can be performed either externally by using either fluidized bed or fixed bed reactors or the crushed coal can be transported through the furnace to achieve the required temperatures. At about 600° C. to about 850° C., preferably about 600° C. to about 700° C., the released products contain hydrocarbon gases, water vapor, carbon dioxide, carbon monoxide, tars, light oils and char. The components that are important for the reduction of oxides of nitrogen are hydrocarbons. Accordingly, in this process of the present invention, these gaseous and solid products are separated into two streams. The pyrolysis gasses are introduced into the combustion chamber downstream from the main combustion zone of the furnace. By maintaining the temperature above 600° C., the condensation of pyrolysis gases can be prevented. These pyrolysis gases contain mainly methane, ethane, acetylene and other hydrocarbons. These gases reduce the oxides of nitrogen produced from the primary combustion zone. Char is also produced from low temperature pyrolysis. The char is preferably sent to a pulverizer along with the along with the other or main stream of coal. The pulverized char is injected into the combustion chamber through the bottom most burner assembly. However, char may not be pulverized and may enter the main burner independently of the main stream of coal or other carbonaceous fuel. This provides longer residence time for the char than when introduced downstream of the main combustion zone and reduces LOI. The main coal stream (about 50 wt % to about 85 wt % of the total weight of the coal) is pulverized using standard pulverizers and admitted into the combustion chamber through other burners.

The present invention preferably uses coal as a reburn fuel for coal combustion systems. The low temperature pyrolyzer serves as a means of producing a gaseous hydrocarbon stream for the reduction of nitrogen oxides produced in the main combustion chamber. If coal is used as a reburn fuel, the residence time available after the reburn zone is not sufficient for complete combustion and results in high carbon loss. The method and system of the present invention resolves the high unburnt carbon problem by just using gases for reduction of oxides of nitrogen. The present invention reduces potential emission of oxides of nitrogen by about 40 to 60%.

The char produced during low temperature pyrolysis is preferably pulverized and introduced into the bottom most burner of the coal furnace thus providing longer residence time for complete burnout. With the present invention, the overall unburnt carbon will be about 15 to 25% lower than a typical low nitrogen oxides burner system. Also, this improves the marketability of the ash.

In summary, the present invention requires low temperature pyrolysis, separation of gases and char, injection of char with the main stream of coal, and injection of gases from low temperature pyrolysis to the main combustion chamber. The present invention separates gas and char, uses the gas to reduce the oxides of nitrogen, and introduces char with the main carbonaceous fuel to increase time for combustion and reduce unburnt carbon.

Although the present invention describes in detail certain embodiments, it is understood that variations and modifications exist known to those skilled in the art that are within the invention. Accordingly, the present invention is intended to encompass all such alternatives, modifications and variations that are within the scope of the invention as set forth in the following claims.

What is claimed is:

1. A method for the reduction of nitrogen oxides and carbon loss from carbonaceous fuel combustion flue emissions of a combustion furnace comprising:

pyrolyzing or thermally decomposing a first portion of said carbonaceous fuel to produce a first gaseous stream and a char fraction, wherein said first portion of said carbonaceous fuel is in an amount from about 15 wt % to about 50 wt % of the total weight of said carbonaceous fuel;

adding said char fraction to the main burner of said combustion furnace;

adding said first gaseous stream to the main combustion chamber of said combustion furnace;

adding a second portion of said carbonaceous fuel to said main burner of said combustion furnace, wherein said second portion of said carbonaceous fuel is in an amount from about 50 wt % to about 85 wt % of the total weight of said carbonaceous fuel;

and combusting said second portion of said carbonaceous fuel, said char, and said first gaseous stream in the main burner of said combustion furnace to produce a second gaseous stream.

2. The method of claim 1, wherein said char fraction is added to said second portion of said carabonaceous fuel.

3. The method of claim 1, wherein said first gaseous stream is added downstream from said second gaseous stream.

4. The method of claim 1, wherein said pyrolyzing is effected within said combustion furnace.

5. The method of claim 1, wherein said pyrolyzing is effected outside of said combustion furnace.

6. The method of claim 1, wherein said pyrolyzing is at a temperature from about 600° C. to about 700° C.

7. The method of claim 1, wherein said combusting of said second portion of said carbonaceous fuel and said first gaseous stream in said main combustion chamber of said combustion furnace is at a temperature from about 1300° C. to about 1700° C.

8. The method of claim 1, wherein said carbonaceous fuel is selected from the group consisting of petroleum coke, bitumen, fuel oil, biomass, non aqueous mixtures thereof, and aqueous mixtures thereof.

9. The method of claim 1, wherein said carbonaceous fuel is biomass.

10. The method of claim 9, wherein said biomass comprises sawdust.

11. The method of claim 1, wherein said char fraction and said second portion of said carbonaceous fuel are pulverized prior to combusting.

12. The method of claim 1, further comprising venting said second gaseous stream to the atmosphere.

13. The method of claim 1, further comprising recycling said second gaseous stream to said main combustion chamber.

14. A combustion furnace system for reduction of nitrogen oxides and carbon loss from carbonaceous fuel combustion flue emissions comprising:

means for pyrolyzing or thermally decomposing a first portion of said carbonaceous fuel to produce a first gaseous stream and a char fraction;

means for combusting a second portion of said carbonaceous fuel;

means for adding said char fraction to said second portion of said carbonaceous fuel;

means for adding said first gaseous stream to said means for combusting said second portion of said carbonaceous fuel.

15. The system of claim 14, wherein said carbonaceous fuel is selected from the group consisting of coal, biomass, petroleum coke, bitumen, fuel oil, non aqueous mixtures thereof, and aqueous mixtures thereof.

16. The system of claim 14, wherein said carbonaceous fuel is coal.

17. The system of claim 14, wherein said carbonaceous fuel is biomass.

18. The system of claim 17 wherein said biomass comprises sawdust.

19. The system of claim 14, wherein said means for pyrolyzing is at a temperature from about 600° C. to about 850° C.

20. The system of claim 14, wherein said means for combusting said second portion of said carbonaceous fuel is at a temperature from about 1300° C. to about 1700° C.

21. The system of claim 14, further comprising means for pulverizing said char fraction and said second portion of said carbonaceous fuel.

22. The system of claim 14, further comprising means for venting to the atmosphere combustion fuel emissions.

23. The system of claim 14, further comprising means for recycling combustion fuel emissions to said means for combusting said second portion of said carbonaceous fuel.

24. A method for the reduction of nitrogen oxides and carbon loss from coal fuel combustion flue emissions of a combustion furnace comprising:

pyrolyzing or thermally decomposing a first portion of said coal fuel to produce a first gaseous stream and a char fraction, wherein said first portion of said coal fuel is in an amount from about 15 wt % to about 50 wt % of the total weight of said carbonaceous fuel;

adding said char fraction to the main burner of said combustion furnace; adding said first gaseous stream to the main combustion chamber of said combustion furnace;

adding a second portion of said coal fuel to said main burner of said combustion furnace, wherein said second portion of said coal fuel is in an amount from about 50 wt % to about 85 wt % of the total weight of said coal fuel;

and combusting said second portion of said coal fuel, said char, and said first gaseous stream in the main burner of said combustion furnace to produce a second gaseous stream.

25. The method of claim 24, wherein said wherein said char fraction is added to said second portion of said coal fuel.

26. The method of claim 24, wherein said first gaseous stream is added downstream from said second gaseous stream.

27. The method of claim 24, wherein said pyrolyzing is effected with said combustion furnace.

28. The method of claim 24, wherein said pyrolyzing is effected outside of said combustion furnace.

29. The method of claim 24, wherein said pyrolyzing is at a temperature from about 600° C. to about 700° C.

30. The method of claim 24, wherein said combusting of said second portion of said coal fuel and said first gaseous stream in said main combustion chamber of said combustion furnace is at a temperature from about 1300° C. to about 1700° C.

* * * * *

UNITED STATES PATENT AND TRADEMARK OFFICE

CERTIFICATE OF CORRECTION

PATENT NO. : 6,599,118 B2
DATED : July 29, 2003
INVENTOR(S) : Sarma V. Pisupati

It is certified that error appears in the above-identified patent and that said Letters Patent is hereby corrected as shown below:

Column 8,
Line 16, "effected with said" should read -- effected within said --.

Signed and Sealed this

Eighteenth Day of November, 2003

JAMES E. ROGAN
*Director of the United States Patent and Trademark Office*